US011779927B2

(12) United States Patent
Moon et al.

(10) Patent No.: US 11,779,927 B2
(45) Date of Patent: Oct. 10, 2023

(54) ON-CHIP ORGANIC SYNTHESIS ENABLED BY ENGINE-AND-CARGO IN AN ELECTROWETTING-ON-DIELECTRIC DIGITAL MICROFLUIDIC DEVICE

(71) Applicant: Board of Regents, The University of Texas System, Austin, TX (US)

(72) Inventors: Hyejin Moon, Euless, TX (US); Matin Torabinia, Arlington, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 387 days.

(21) Appl. No.: 16/926,947

(22) Filed: Jul. 13, 2020

(65) Prior Publication Data

US 2021/0023563 A1 Jan. 28, 2021

Related U.S. Application Data

(60) Provisional application No. 62/878,431, filed on Jul. 25, 2019.

(51) Int. Cl.
*B01L 3/00* (2006.01)

(52) U.S. Cl.
CPC ..... *B01L 3/502792* (2013.01); *B01L 3/50273* (2013.01); *B01L 2200/0673* (2013.01); *B01L 2300/0645* (2013.01); *B01L 2300/0819* (2013.01); *B01L 2400/0427* (2013.01)

(58) Field of Classification Search
CPC ..... B01L 3/50273; B01L 3/502792; B01L 2200/0673; B01L 2400/0427
See application file for complete search history.

(56) References Cited

PUBLICATIONS

S-K Fan, Encapsulated droplets with metered and removable oil shells by electrowetting and dielectrophoresis, Lab on a Chip, 2011 (11), p. 2500-08. (Year: 2011).*
I.M. Hauner, The Dynamic Surface Tension of Water, The Journal of Physical Chemistry, 2017(8), p. 1599-1603. (Year: 2017).*
M.G. Freire, Surface tensions of imidazolium based ionic liquids: anion, cation, temperature and water effect, Journal of Colloid and Interface Science, 2007(314), p. 621-30. (Year: 2007).*
M.M. Nahar, Study of Compound Droplet Dynamics and Separation of Immiscible Liquids on EWOD DMF; Proceedings of the 12th IEEE Internationl Conference on Nano/Micro Engineered and Molecular Systems Apr. 9-12, 2017, Los Angeles, USA, p. 694-97. (Year: 2017).*
P. Dubois, Ionic Liquid Droplet as e-Microreactor, Anal. Chem. 2006(78), p. 4909-17. (Year: 2006).*
(Continued)

*Primary Examiner* — Caitlyn Mingyun Sun
(74) *Attorney, Agent, or Firm* — John P. Zimmer; Nexsen Pruet, PLLC

(57) ABSTRACT

A method of moving a solvent without electrowetting properties on an electro-wetting-on-dielectric (EWOD) microfluidic device comprises disposing a first droplet of a first fluid having electrowetting properties on a surface of the EWOD microfluidic device; disposing a second droplet of a second fluid without electrowetting properties on the surface; applying a voltage to the surface to move the first droplet towards the second droplet; contacting the first droplet with the second droplet to form a encapsulated droplet, where the second droplet encapsulates the first droplet.

19 Claims, 13 Drawing Sheets

(56) References Cited

PUBLICATIONS

J. Li, Electrowetting-on-dielectrics for manipulation of oil drops and gas bubbles in aqueous-shell compound drops, Lab on a Chip, 2014(14), p. 4334-37. (Year: 2014).*
99 Ossila Contact Angle Surface Energy. (Year: 2022).*

* cited by examiner

| (g) Design of Experiment | | | | | | | | |
|---|---|---|---|---|---|---|---|---|
| Configuration / Reaction Characterization | Engine | Cargo solution | | | Other reactant | | Quenching agent | Reaction time (s) |
| | | Catalyst (Loading) | Reactant | Solvent | Reactant | Solvent | | |
| Kinetic Study | [bmim]$PF_6$ | DMAP (0.5 mol%) | menthol, $Et_3N$ | toluene | $Ac_2O$ | toluene | $NaHCO_3$ | 10 , 20 , 30 , 40, 50, 60, 70, 80, 90 |
| Solvent Screening | [bmim]$PF_6$ | DMAP (0.5 mol %) | menthol, $Et_3N$ | toluene, dioxane, DMF, DCE | $Ac_2O$ | toluene, dioxane, DMF, DCE | $NaHCO_3$ | 30 |
| Optimize Catalyst Loading | [bmim]$PF_6$ | 0.1 %, 0.5 1.0 1.5 mol % | menthol, $Et_3N$ | toluene | $Ac_2O$ | tuluene | $NaHCO_3$ | 30 |
| Parallel esterification reactions | [bmim]$PF_6$ | DMAP (0.5 mol %) | menthol, benzyl alcohol, phenol / $Et_3N$ | toluene | $Ac_2O$ | toluene | $NaHCO_3$ | 30 |

FIG 5(g)

ON-CHIP ORGANIC SYNTHESIS ENABLED BY ENGINE-AND-CARGO IN AN ELECTROWETTING-ON-DIELECTRIC DIGITAL MICROFLUIDIC DEVICE

CROSS-REFERENCE TO RELATED APPLICATIONS

This application claims priority under 35 U.S.C. § 119(e) to U.S. Provisional Patent Application No. 62/878,431 filed Jul. 25, 2019, the entirety of which is incorporated by reference herein.

STATEMENT REGARDING GOVERNMENT FUNDING

This invention was made with government support under grant no. ECCS-1254602 awarded by the National Science Foundation. The government has certain rights in the invention.

FIELD

This invention is generally related to microfluidic devices, and, more specifically, to electrowetting on dielectric microfluidic devices.

BACKGROUND

Over the past decades, microscale chemical reaction technology has been attractive in diverse areas of chemistry. It allows the precise control of quantified reagents and highly efficient heat and mass transfer, because of a large interface-to-volume ratio, particularly in case of the exothermic reaction and mixing. Additionally, it allows for reduced consumption of toxic or expensive agents, improved reaction profiles, and enhanced selectivity compared to macroscale reactions.

Conventional microscale reaction processes typically use continuous microchannel flow systems. For example, various chemical reaction have been performed, such as fluorination of toluene in microchannel reactors made of silicon, and formation of amides via carbonylative cross-coupling of aryl halides with benzyl amine using a reaction channel. Both cases achieved the higher yields than conventional batch reactions within the same time periods. Other examples include Suzuki cross-coupling, Wittig olefination reaction, nitration of benzene, and tripeptide synthesis. Despite successful demonstration of these proof of concept demonstrations, microchannel-based approaches suffer from several limitations. For example, clogging of the channels by products or byproducts often results in difficulty maintaining a constant hydrodynamic pressure and a stable flow. The requirement of a complex flow network and cross-contamination due to unwanted diffusion through channels also has been observed to be problematic. Moreover, solvent-swapping processes pose very challenging problems in microchannel reactors. Another in the context of combinatorial chemistry, microchannel reactors present additional challenges. For instance, since a combinatorial synthesis through either batch or flow reactors requires as many reactors as the number of all possible combinations of reactants, the reactor system tends to be excessively complex.

A digital microfluidic platform using electrowetting-on-dielectric (EWOD) principle can be an alternative and/or complement a microchannel reactor. An EWOD digital microfluidic platform eliminates the necessity of predetermined channel network and mechanical pumps and valves. Since the EWOD platform uses a droplet-based flow, it can prevent cross-mixing and cross-contamination. Each droplet acts as a batch reactor, which allows the feasibility of performing multi-step reactions that involve solvents swapping and combinatorial synthesis. Researchers have taken advantages of these unique features of EWOD microfluidic devices to conduct on-chip chemical reactions, e.g. reactions in ionic liquid droplets, synthesis of radiotracers, and synchronized synthesis of peptide-based macrocycles. However, all these reactions on EWOD chip utilized solvent fluids that are movable by EWOD actuation. However, contemporary organic synthesis generally requires non-polar or polar aprotic solvents, and their poor movability in an EWOD chip has been a long-standing problem.

Various studies have experimentally assessed the movability of organic solvents and solutions in the EWOD system, and it has been found that many organic solvents, such as cyclohexane, carbon tetrachloride, chloroform, and toluene, cannot be displaced by EWOD actuations. Recently, an electromechanical model has been reported that can predict the movability of a fluid by an EWOD device. This model showed that both the magnitude and the frequency of the operation voltage need to be tuned to obtain maximum force in an EWOD device. At the particular experimental parameters, the model predicted that many indispensable organic solvents for organic synthesis are not movable, which concurs with the reported experimental results.

Additional efforts to operate non-movable fluids in EWOD device resulted in a demonstration that oil, organic, and gaseous chemicals in the aqueous shell could be manipulated. However, such configuration fails to host fluids having a lower surface tension than aqueous solutions. For instance, most of organic solvents have much lower surface tensions (~20 mN/m) than that of water, which does not allow them to be encapsulated in an aqueous shell. In addition, additional capillary tube settings were needed to create core-shell droplets, leading to unfavorable complexities of device design and fabrications. Another approach was to use dielectrophoretic (DEP) force to operate non-movable fluids; where a silicone oil droplet was observed to be manipulatable by DEP force in a typical EWOD device. However, exerting DEP force required extremely higher voltage than the voltage required in a typical EWOD operation. In addition, fluids must have some specific dielectric properties to be manipulated by DEP force. In fact, it has further been reported that most organic solvents commonly used in chemical reactions are not movable, even in the range of frequency at which DEP force is dominant. These hindrances limit the scope of possible chemical reactions in an EWOD device.

Consequently, there is a need for improved methods and EWOD devices that can move most organic solvents under typical EWOD conditions.

SUMMARY

Methods of conducting a microfluidic chemical reaction using an electro-wetting-on-dielectric (EWOD) digital microfluidic device are described herein. Despite of numbers of chemical/biological applications using EWOD digital microfluidic device, its application to organic reactions have been seriously limited because most of common solvents used for synthetic organic chemistry are not operable on EWOD device. In some embodiments, an "engine-and-cargo" system that enables use of non-movable fluids (e.g., organic solvents) on an EWOD device is described herein. With esterification as the model reaction, on-chip chemical reactions can be performed. Conversion data obtained from on-chip reactions were used in the demonstration of reaction characterization and optimization such as reaction kinetics, solvent screening, and catalyst loading. As the first step toward on-chip combinatorial synthesis, parallel esterification of three different alcohols are also demonstrated.

In an aspect, a method of moving a solvent without electrowetting properties on an electro-wetting-on-dielectric (EWOD) microfluidic device is described herein, the method comprising: disposing a first droplet of a first fluid having electrowetting properties on a surface of the EWOD microfluidic device; disposing a second droplet of a second fluid without electrowetting properties on the surface; applying a voltage to the surface to move the first droplet towards the second droplet; contacting the first droplet with the second droplet to form a encapsulated droplet, where the second droplet encapsulates the first droplet. In some embodiments, the method can further comprise transporting the encapsulated droplet across the surface by applying a voltage to the surface. The first fluid and the second fluid are immiscible.

In another aspect, a method of moving a solvent without electrowetting properties on an electro-wetting-on-dielectric (EWOD) microfluidic device comprises combining a first fluid with an immiscible second fluid in an EWOD reservoir puddle, the first fluid having electrowetting properties and the second fluid lacking electrowetting properties; moving a first droplet of the first fluid out of the reservoir puddle by applying a voltage to a surface of the EWOD device; encapsulating the first droplet with a second droplet of the second fluid as the first droplet is moved out of the reservoir puddle to form an encapsulated droplet.

In some embodiments, the first fluid comprises an ionic liquid. The ionic liquid can comprise an organic cation that is imidazolium-based, pyridinium-based, pyrrolidinium-based, phosphonium-based, ammonium based, sulfonium-based, or any combination thereof. The ionic liquid can comprise an anion that is an alkylsulfate, tosylate, methansulfonate, trifluoromethanesulfonate (triflate), bis(trifluoromethylsulfonyl)imide, tetrafluoroborate, hexafluorophosphate, a halide, or an combination thereof. In a preferred embodiment, the ionic liquid is 1-butyl-3-methylimidazolium hexafluorophosphate (BMIM-PF6).

In some embodiments, the second fluid has a lower surface tension than water. In some cases, the first fluid has a higher surface tension than the second fluid. In some instances, the second fluid is an organic solvent.

Methods described herein can further comprise forming a two or more encapsulated droplets on the surface. The methods can further comprise applying a voltage to the surface to move the two or more encapsulated droplets together. In some instances, the method can further comprise merging the two or more encapsulated droplets together. The merging the two or more encapsulated droplets can comprise mixing the second fluids from each encapsulated droplets together.

In some embodiments, the second fluid of each encapsulated droplet comprises one or more reactants. In this example, merging the two or more encapsulated droplets together can initiate a chemical reaction between the one or more reactants present in the encapsulated droplets.

The first fluid in each encapsulated droplet can be the same or different. Similarly, the second fluid in each encapsulated droplet can be the same or can be different.

BRIEF DESCRIPTION OF THE DRAWINGS

FIG. 1(*a*) shows actuation of the engine towards the cargo, FIG. 1(*b*) shows encapsulation and formation of engine-and-cargo, and FIG. 1(*c*) shows the motion of an engine droplet by electrowetting operation leads motion of an entire compound droplet, thus fluidic functionalities of cargo droplet. Images from the top view of the EWOD device. Blue dye was added to the ionic liquid for the better visualization purpose only.

FIG. 4(*a*) shows an initial state, FIG. 4(*b*) The viscous drag between the engine and cargo fluids stretched the cargo fluid, FIG. 4(*c*) The engine droplet was dispensed and it pulled the cargo further so that a neck formed in the cargo and the hydrodynamic instability grew, and FIG. 4(*d*) the cargo neck eventually pinched off and formed an engine-and-cargo system. FIG. 4(*a*) is a processed image to clearly highlight the electrode layout while still show the beginning of the dispensing process.

FIG. 5(*b*) shows a reagent solution is dispensed and merged with the engine-and-cargo droplet; FIG. 5c) shows esterification proceeding; FIG. 5(*d*) shows a quenching agent dispensed from the reservoir and transferred to the reacting droplet; FIG. 5(*e*) shows that as the quenching agent droplet and the reacting droplet merge, reaction is quenched and stops; and FIG. 5(*f*) shows after quenching, the reaction mixture is drawn out using a syringe and is diluted with DCM within the GC vials and placed in the GC-MS machine.

FIG. 5(*g*) shows design of experiment summarizes conditions of all reactions tested for FIGS. 4(*a*)-4(*d*).

FIG. 6(*b*) is GC spectrometry showing the results of 3 off-chip reactions. All three reactions showed full conversions and provided the ester product cleanly.

FIG. 6(*c*) is MS results confirming the identity of menthol (e.g., C1) before the reaction and acetylated menthol (e.g., C2) after all three experiments.

DETAILED DESCRIPTION

Embodiments described herein can be understood more readily by reference to the following detailed description, examples, and figures. Elements, apparatus, and methods described herein, however, are not limited to the specific embodiments presented in the detailed description, examples, and figures. It should be recognized that the exemplary embodiments herein are merely illustrative of the principles of the invention. Numerous modifications and adaptations will be readily apparent to those of skill in the art without departing from the spirit and scope of the invention.

In addition, all ranges disclosed herein are to be understood to encompass any and all subranges subsumed therein. For example, a stated range of "1.0 to 10.0" should be considered to include any and all subranges beginning with a minimum value of 1.0 or more and ending with a maximum value of 10.0 or less, e.g., 1.0 to 5.3, or 4.7 to 10.0, or 3.6 to 7.9.

All ranges disclosed herein are also to be considered to include the end points of the range, unless expressly stated otherwise. For example, a range of "between 5 and 10" or "5 to 10" or "5-10" should generally be considered to include the end points 5 and 10.

Further, when the phrase "up to" is used in connection with an amount or quantity; it is to be understood that the amount is at least a detectable amount or quantity. For example, a material present in an amount "up to" a specified amount can be present from a detectable amount and up to and including the specified amount.

Additionally, in any disclosed embodiment, the terms "substantially," "approximately," and "about" may be substituted with "within [a percentage] of" what is specified, where the percentage includes 0.1, 1, 5, and 10 percent.

In an aspect, new methods of "engine-and-cargo" are described herein which enable an EWOD device to handle electrically non-responsive fluids such as organic solvents. This approach can allow a wide range of organic syntheses in EWOD devices. It has long been suggested that the true product from microfluidic reaction systems would be information, rather than a more tangible substances or intermediates. As like other types of microfluidic reactors, on-chip syntheses in EWOD devices would transform to parallel reactor systems (i.e., numbering up) rather than to scale up to production systems. Vast information obtained from fast and automated on-chip chemical reactions could be utilized for reaction optimization and chemical discovery. EWOD devices are capable of integrating on-chip chemical synthesis capacity with biological/biomedical functions such as cell culture, bio-separations, and biosensors, this permits a complete drug discovery platform to be performed on a single EWOD device.

Figure 1:
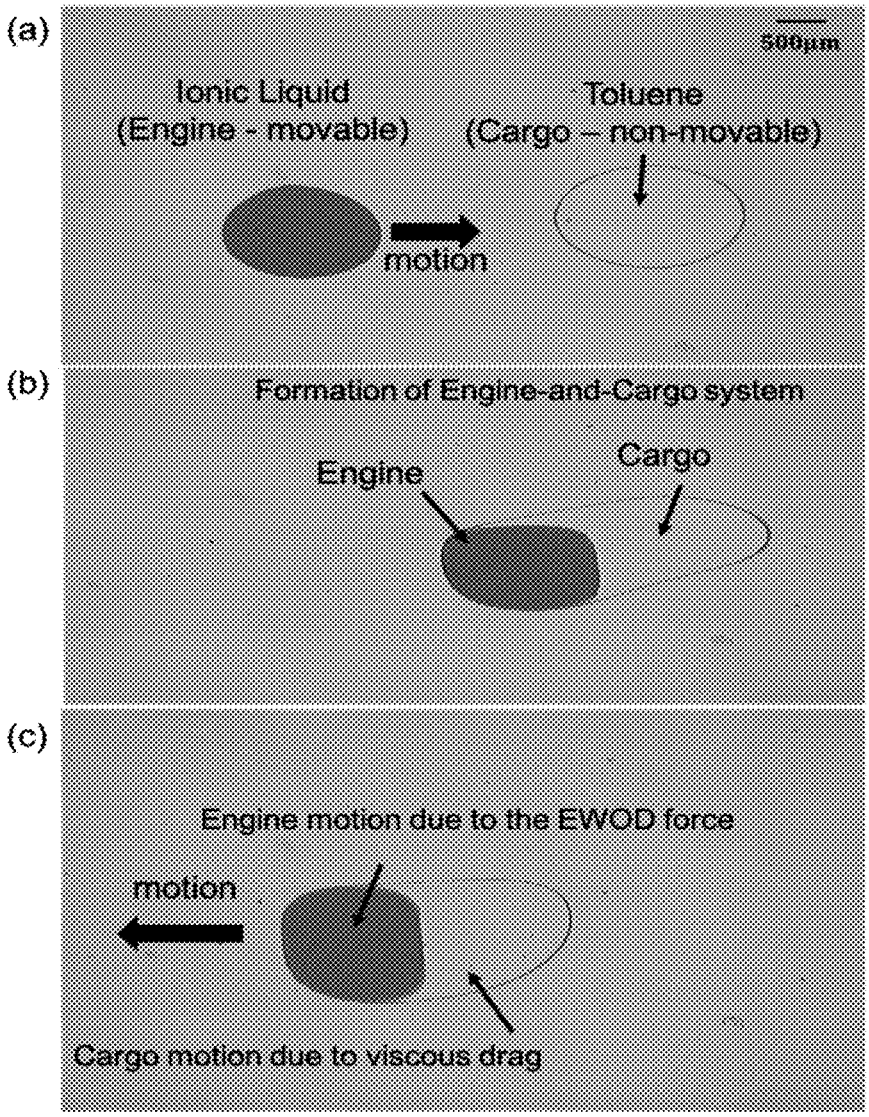
FIGS. 1(*a*)-1(*c*) shows the formation of the engine-and-cargo system of an ionic liquid ([bmim]$PF_6$) as the engine (movable) and toluene as the cargo (non-movable).
Figure 4:
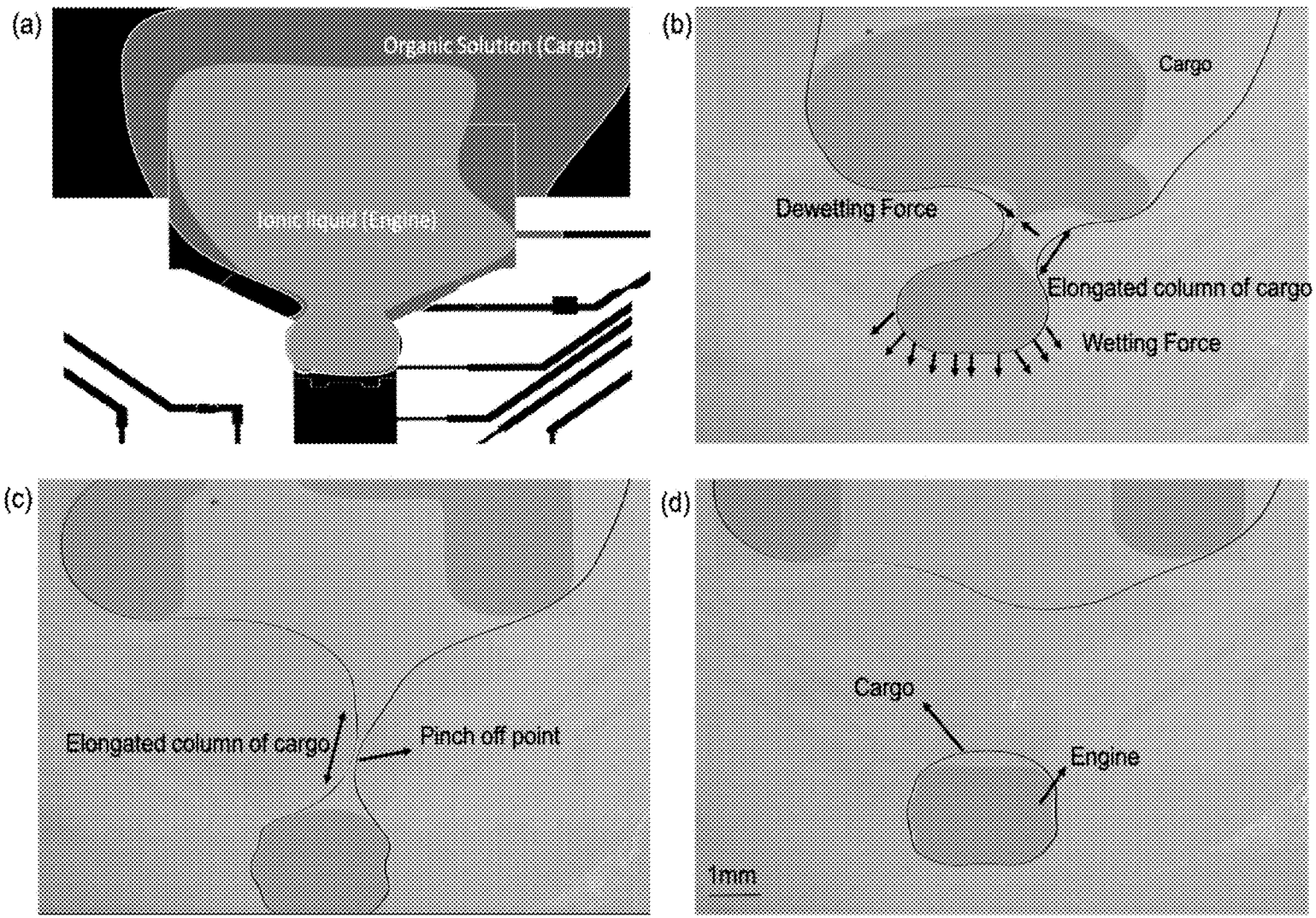
FIGS. 4(*a*)-4(*d*) A sequence of formation of an engine-and-cargo system from the reservoir.

In an aspect, a method of moving a solvent without electrowetting properties on an electro-wetting-on-dielectric (EWOD) microfluidic device is described herein comprising: disposing a first droplet of a first fluid having electrowetting properties on a surface of the EWOD microfluidic device, such as a fluid that is polar or electrically responsive; disposing a second droplet of a second fluid without electrowetting properties on the surface, such as a fluid that is non-polar or electrically non-responsive; applying a voltage to the surface to move the first droplet towards the second droplet; contacting the first droplet with the second droplet to form a encapsulated droplet, where the second droplet encapsulates the first droplet. FIGS. 1(*a*)-1(*c*) demonstrate this method. In some embodiments, the method can further comprise transporting the encapsulated droplet across the surface by applying a voltage to the surface. In another aspect, a method of moving a solvent without electrowetting properties on an electro-wetting-on-dielectric (EWOD) microfluidic device comprises combining a first fluid with an immiscible second fluid in an EWOD reservoir puddle, the first fluid having electrowetting properties and the second fluid lacking electrowetting properties; moving a first droplet of the first fluid out of the reservoir puddle by applying a voltage to a surface of the EWOD device; encapsulating the first droplet with a second droplet of the second fluid as the first droplet is moved out of the reservoir puddle to form an encapsulated droplet. FIGS. 4(*a*)-4(*d*) demonstrate this method. The first fluid and the second fluid in both methods are immiscible.

In some embodiments, the first fluid comprises an ionic liquid. An ionic liquid described herein can be any ionic liquid not inconsistent with the objectives of this disclosure. Generally, an ionic liquid is a salt that is in a liquid state. Often ionic liquids are a combination of an organic cation and a variety of organic and inorganic anions. In some embodiments, ionic liquids described herein have an organic cation that is imidazolium-based, pyridinium-based, pyrrolidinium-based, phosphonium-based, ammonium based, sulfonium-based, or any combination thereof. Ionic liquids described herein can have an anion that is an alkylsulfate, tosylate, methansulfonate, trifluoromethanesulfonate (triflate), bis(trifluoromethylsulfonyl)imide, tetrafluoroborate, hexafluorophosphate, a halide, or an combination thereof.

In some embodiments, the ionic liquid is an imidazolium-based ionic liquid. For example, in some cases, the imidazolium-based ionic liquid comprises 1-butyl-3-methylimidazolium hexafluorophosphate (BMIM-$PF_6$), 1-butyl-3-methylimidazolium tetrafluoroborate (BMIM-$BF_4$), ethyl-3 methylimidazoliuim triflate, ethyl-3 methylimidazoliuim tetrafluroboroate, ethyl-3 methylimidazoliuim bis(trifluromethylsulfonyl)imide, or any combination thereof. In a preferred embodiment, the ionic liquid is 1-butyl-3-methylimidazolium hexafluorophosphate (BMIM-PF6).

In some embodiments, the second fluid has a lower surface tension than water, as described in more detail below in the Examples. However, the method is not limited to this, and in some cases, the first fluid can have a higher surface tension than the second fluid.

In some instances, the second fluid is an organic solvent that lacks electrowetting properties, such as toluene, acetone, dichloromethane, an ether, or any other commonly used organic solvent known to the skilled artisan.

Methods described herein can further comprise forming a two or more encapsulated droplets on the surface, such as a plurality of encapsulated droplets. The methods can further comprise applying a voltage to the surface to move the two or more encapsulated droplets together. In some instances, the method can further comprise merging the two or more encapsulated droplets together. The merging the two or more encapsulated droplets can comprise mixing the second fluids from each encapsulated droplets together. Merging can also comprise mixing the first fluids from each encapsulated droplet together in some instances.

In some embodiments, the second fluid of each encapsulated droplet comprises one or more reactants. In this example, merging the two or more encapsulated droplets together can initiate a chemical reaction between the one or more reactants present in the encapsulated droplets. Using a substitution reaction as a non-limiting example, one encapsulated droplet can comprise a nucleophile dissolved in a second fluid, and the other encapsulated droplet can comprise an electrophile dissolved in a second fluid, and upon merging of the encapsulated droplets, the nucleophile can react with the electrophile to form a reaction product. The first fluid in each encapsulated droplet can be the same or different, based on the solubility requirements of the reactant present in the droplet, and/or the requirements of the intended chemical reaction to be conducted. Similarly, the second fluid in each encapsulated droplet can be the same or can be different for at least the same reasons.

Some embodiments described herein are further illustrated in the following non-limiting examples.

Example 1

Movement of an Organic Solvent without Electrowetting Properties

An engine-and-cargo system described herein harnesses a compound droplet of two immiscible fluids. An engine can be referred to as a fluid that has the electrowetting properties such as a first fluid. A cargo can be referred to as a fluid without electrowetting properties such as a second fluid, and is thusly non-movable in an EWOD device.

FIG. 1 shows the formation and operation of an engine-and-cargo system in an EWOD device. In this example, ionic liquid BMIM-$PF_6$) works as the engine and toluene is carried as the cargo. As shown in FIG. 1(*a*), the ionic liquid has electrowetting properties so that it moves as responding to the applied voltage on electrodes underneath it, whereas toluene stays unresponsive under any magnitude and frequency of voltages. When the ionic liquid droplet approaches to the toluene droplet, it is encapsulated by toluene spontaneously to minimize the surface free energy and forms a compound droplet (an encapsulated droplet) (FIG. 1(*b*)). Note that surface tension of ionic liquid (~40 mN/m) is higher than that of toluene (~20 mN/m). FIG. 1(*c*) presents the motion of the engine-and-cargo system, arising from the electrowetting force exerted on the engine that carries the cargo by viscous drag force. The designed engine-and-cargo system enables the use of toluene and other non-movable fluids in a typical EWOD device without any modification of device structures and architectures. In the later section of this study, it is reported that all the basic fluidic functions of an EWOD digital microfluidic device including dispensing, transporting, merging, and splitting of droplets are achieved with electrically non-responsive fluids. This technique has the potential to make substantial advances on biological and chemical protocols processed on EWOD digital microfluidic device.

Example 2

Esterification Reaction on an EWOD Device Using an Organic Solvent

Esters are an important class of organic molecules that are widely used in synthesis of fine chemicals, drugs, food preservatives, perfumes, plasticizers, and pharmaceuticals. In a biological aspect, acetylation is one of important protein modification methods in cell biology that has an impact on gene expression and metabolism. There are high demands of rapid, simple, and environmentally friendly protocols for the microscale esterification of alcohols for facile production of a wide variety of esters for medicinal and biological applications. Hence, the esterification in microchannel reactors has been studied comprehensively.

Figure 2:
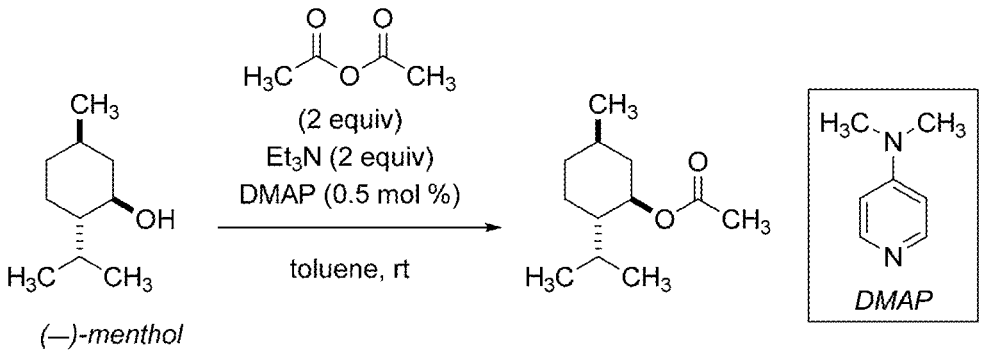
FIG. 2 is a model esterification reaction using menthol, acetic anhydride ($Ac_2O$), trimethylamine ($Et_3N$), and DMAP in the presence of specific solvent. Menthol (5 μmol), $Et_3N$ (10 μmol), DMAP (0.1 to 5 mol %), and $Ac_2O$ (10 μmol) were separately dissolved into 1 μL of corresponding solvent and used for reactions in EWOD digital microfluidic devices.

In this Example, esterification of alcohols with acetic anhydride is used as a model reaction to demonstrate the on-chip organic synthesis capabilities of an EWOD digital microfluidic device using methods described herein. A total of 60 tests with 20 different conditions of esterification reactions of secondary alcohols with acetic anhydride were carried out on-chip. The esterification of menthol, one of 60 reactions is shown in FIG. 2. A traditional macroscale esterification (e.g., flask-based protocol) involves aliquoting, introducing, and mixing reagents, followed by quenching the reaction at controlled time. Instead, on EWOD chip, a reaction can be initiated by generating reagents droplets, transporting, and merging droplets, and at the end of the processes the reaction is quenched by merging the reacting droplet with the quenching agent droplet.

All EWOD microfluidic devices used in this study were fabricated in the Shimadzu Institute Nanotechnology Research Center of the University of Texas at Arlington. Actuation electrodes in the bottom plate of an EWOD device were fabricated by photolithography followed by wet etching of an indium tin oxide (ITO) layer (100 nm) coated on a glass wafer. The dielectric layer (SU-8, 5 μm) and the hydrophobic layer (Teflon, 300 nm) were spin-coated and oven baked. The details of the fabrication steps can be found elsewhere and in ESI.

The EWOD operation voltages (100 Vrms at 1 kHz) were provided by Agilent arbitrary waveform generator and the TEGAM high voltage amplifier (model 23400). Desired sequence of turning on/off electrodes were applied through Lab VIEW program. Droplet motions were recorded using Hirox KH-1300 digital microscope system.

(−)-Menthol (99%), phenol, ≥99.5% (GC), benzyl alcohol anhydrous, 99.8%, trimethylamine, acetic anhydride, 4-(dimethylamino) pyridine (DMAP) (≥90%) were purchased from SIGMA-ALDRICH (USA). Toluene (Certified ACS), 1,4-dioxane, N,N-dimethylformamide, 1,1-dichloroethane (DCE), dichloromethane, (>99.8%) and 1-butyl-3-methylimidazolium hexafluorophosphate ([bmim]$PF_6$) (98+%) obtained from Fisher Scientific. Assorted food and egg dye purchased from Walmart (USA). All chemicals were analytical grade and used as received.

Figure 3:
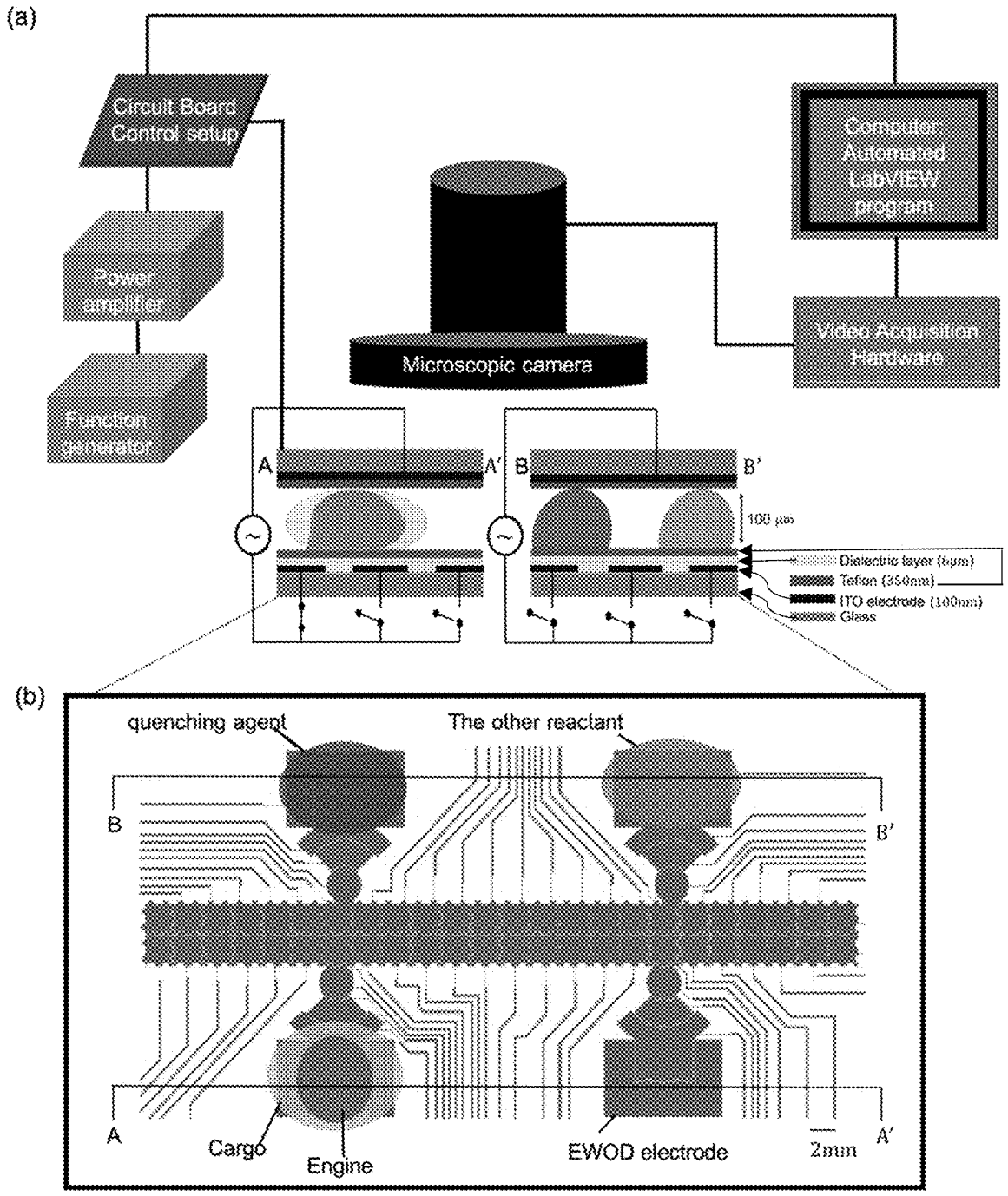
FIG. 3(*a*) shows an experimental setup and the side view schematics of the EWOD chip operation, and FIG. 3(*b*) shows the EWOD chip electrodes layouts and the placement of reagents on the chip at the beginning of each test. The cargo is the solution of a part of reactants and the catalyst-menthol, trimethylamine, and DMAP. The other reactant is acetic anhydride solution. The engine is [bmim]PF6. The quenching agent is saturated aqueous sodium bicarbonate. The surrounding medium is air throughout all the experiment.

Before each test, reagents were placed in designated reservoirs as illustrated in FIG. 3(*b*). Among the esterification reagents listed in FIG. 2, alcohol (i.e., menthol), trimethylamine, and DMAP were identified as non-movable fluids on the EWOD platform. A solution of these 3 reagents were prepared and placed at 'cargo' reservoir, where they were sitting together with the 'engine' fluid (i.e., ionic liquid). On the other hand, acetic anhydride (acylating reactant) and sodium bicarbonate (quenching agent) are movable in the EWOD platform due to their electrowetting properties, so that they were operated without the help of engine droplets.

Each test began with forming an engine-and-cargo compound droplet. FIG. 4 shows the sequence of formation of an engine-and-cargo droplet from the reservoir. First, EWOD forces let an engine fluid droplet dispensed from its reservoir puddle (FIG. 4(*a*)-(*b*)) while the cargo puddles remained non-responsive to the sequence of activation voltages. As the engine droplet was dispensed and moved further away from the reservoir, cargo solution was drawn together due to the viscous drag force between the engine droplet and the cargo solution and a neck in the cargo solution formed (FIG. 4(*c*)). Afterwards, the hydrodynamic instability at the cargo neck eventually let it pinch-off as shown in FIGS. 4(*c*) and (*d*). The completely detached droplet from the reservoir was an engine-and-cargo compound droplet (FIG. 4(*d*)).

The volume of dispensed cargo solution was estimated by multiplying the footprint area (i.e., the area observed from the top view of the droplet) of cargo with the gap between top and bottom plates of the device. Note that the gap (=100 μm) was well controlled and kept invariant throughout the entire device, so the variation in the footprint are was directly proportion to the variation in the droplet volume. The footprint area of cargo was measured using ImageJ software. The details of the volume measurement and calibration is described in ESI.

Figure 5:
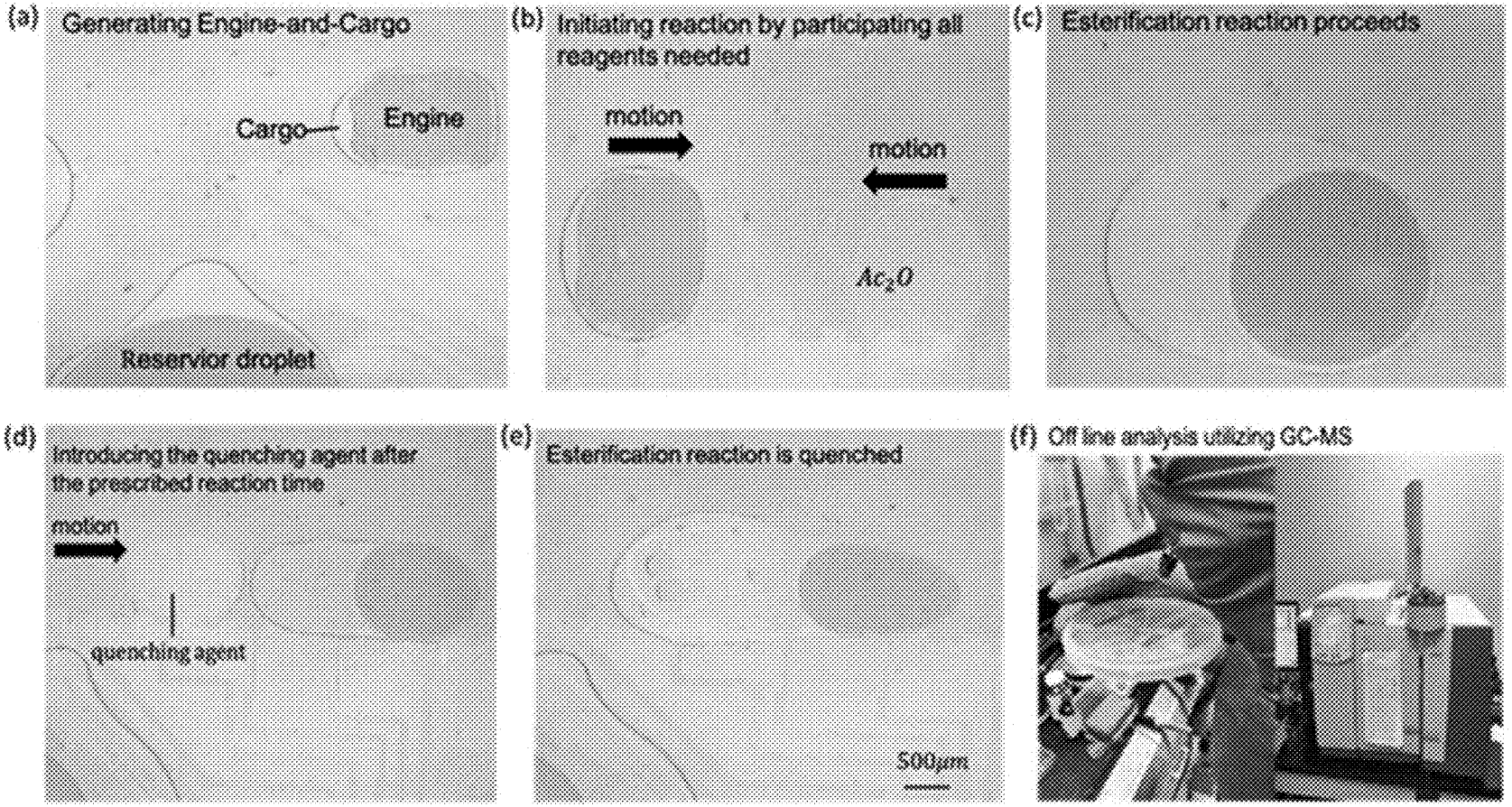
FIGS. 5(*a*)-5(*f*) are sequential photos illustrating the steps of esterification on an EWOD device, where FIG. 5(*a*) shows an engine-and cargo compound droplet is dispensed from the reservoir.

FIGS. 5(*a*)-(*f*) summarize the general procedure of each on-chip reaction test protocol. First, an engine-and-cargo was dispensed (FIG. 5(*a*)). Then, a droplet of the other reactant solution was dispensed from its reservoir and it was merged with the previously dispensed engine-and-cargo (FIG. 5(*b*)). As they merged, the esterification began and continued to proceed (FIG. 5(*c*)). A droplet of a quenching agent was dispensed from the reservoir and delivered to the reacting droplet at the prescribed reaction time (FIG. 5(*d*)). This let the reaction stop right at the prescribed reaction time (FIG. 5(*e*)). Then, the reaction mixture (organic layer) was carefully drawn out using a syringe and diluted with DCM in a GC vial, which was subjected to the GC-MS analysis to measure a conversion of the reaction (FIG. 5(*f*)).

While demonstrating capability of an EWOD device to carry out organic reactions, three reaction parameters-reaction time, type of solvents, and catalyst concentration—of on-chip esterification reactions of secondary alcohols with acetic anhydride were independently evaluated and summarized in FIG. 5(*g*).

For the kinetic study, other reaction parameters (e.g., catalyst concentration and solvent) were fixed and the reaction were monitored from 10 s to 90 s. For the solvent screening, catalyst concentration and reaction time were fixed and 4 different solvents (i.e., toluene, dioxane, N,N-dimethylformamide, and DCE) were tested. For the optimization of catalyst loading, solvent and reaction time were fixed and the concentration of catalyst was varied from 0.1 to 1.5 mol %.

As simulating parallel synthesis esterification of three substrates was performed under basic conditions, the substrates including menthol, benzyl alcohol, and phenol with acid anhydride (FIG. 5(*g*), the bottom row) on a single EWOD chip. In the beginning of the test, all reagents including 3 substrates were placed in the designated reservoirs of the chip. To be able to perform true parallel reactions (i.e., 3 reactions run simultaneously), complete automation of EWOD chip operation is necessary. The 3 reactions were performed in series as each reaction followed the order of FIG. 5(*a*)-(*f*). The reactivity difference of these three substrates was examined over the first 30 s of each reaction.

Figure 6A:
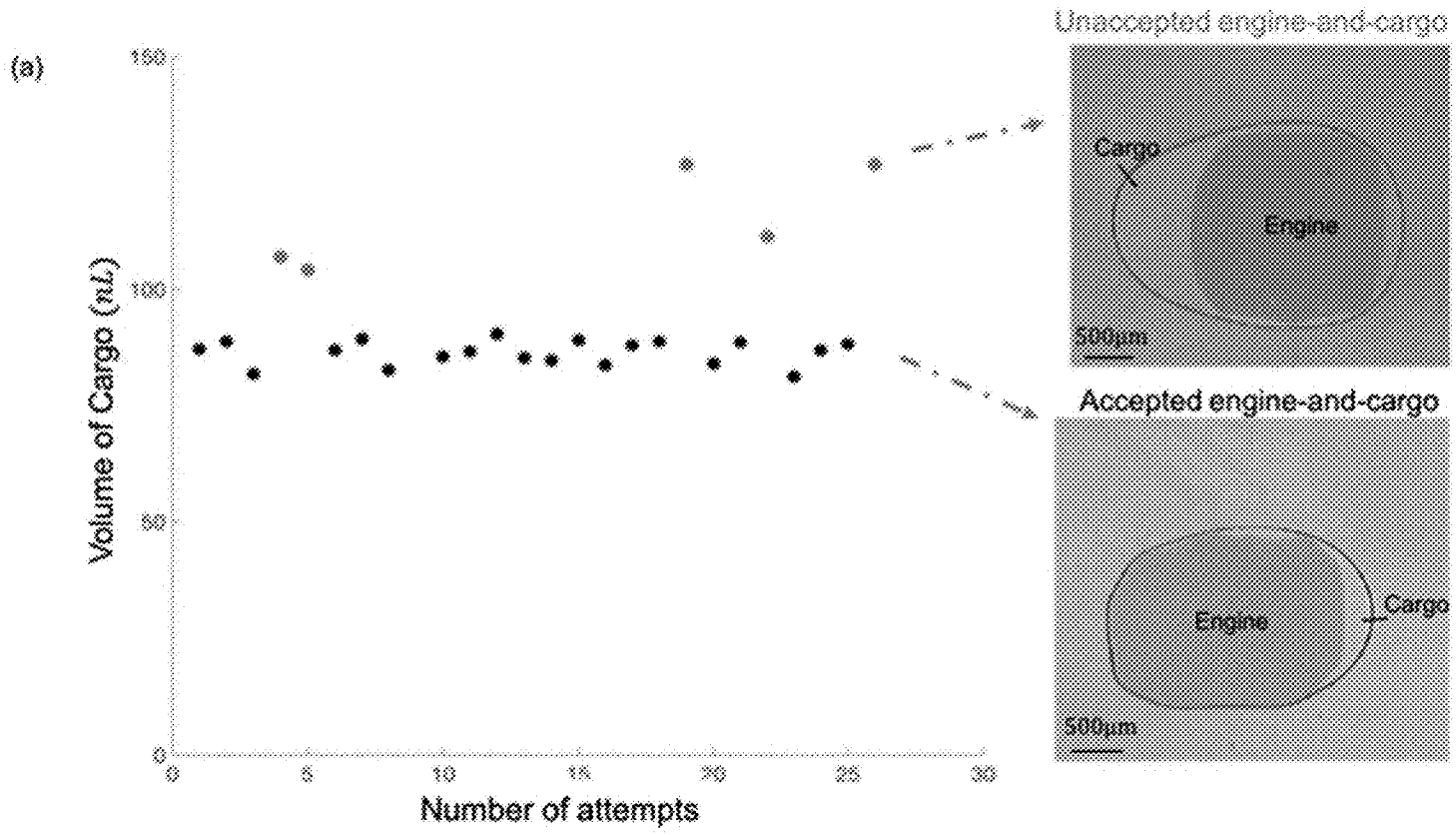
FIG. 6(*a*) Shows a cargo volume of 26 engine-and-cargo droplets consecutively dispensed from a reservoir. By excluding outliers (red dots), volume inconsistency was kept as low as 3%. As shown the difference between acceptable and unacceptable was very much visually noticeable.
Figure 6B:
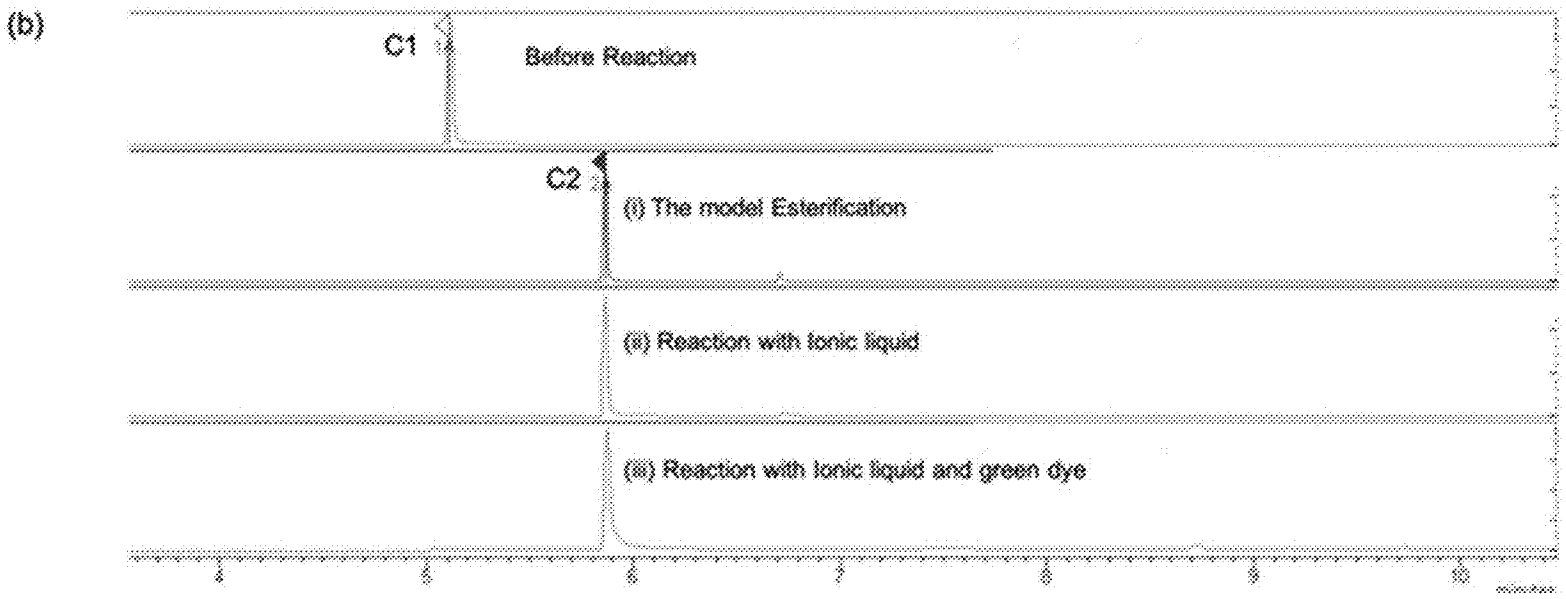
Figure 6C:
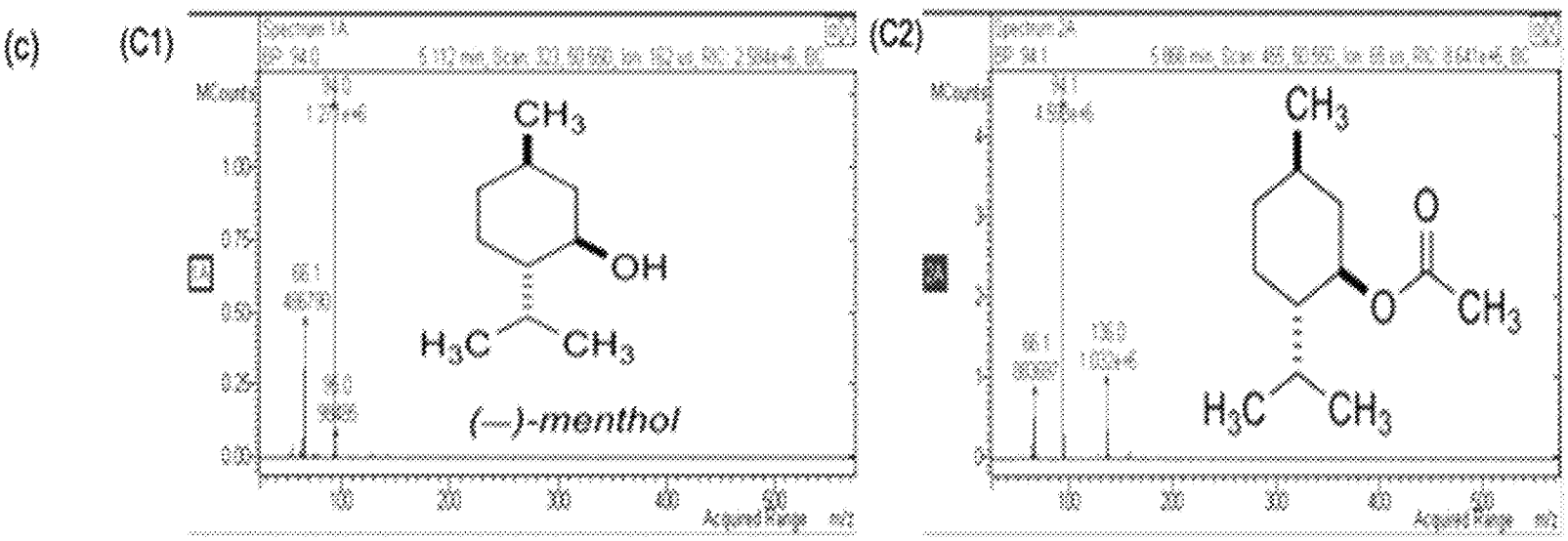

It is generally observed that most of chemical and biological applications of lab-on-chip devices require the volume inconsistency below ±5%. To assess the cargo volume inconsistency, 26 engine-and-cargo droplets were generated consecutively and characterized cargo volumes. During the tests, the cargo reservoir was kept refilled as it depleted. As it is evident from FIG. 6(*a*), after 3 dispensing of droplets with the average volume (black dots), the fourth droplet (red dots) was dispensed with larger volume than the average. This is attributed to volume changes of the reservoir puddle after several dispensing of engine-and-cargo droplets. It has been reported that in an EWOD device, a volume of a dispensed droplet has the dependency on a volume of the reservoir puddle. Excluding the red dots, the inconsistency is as low as ±3%. Based on this result, the cargo reservoir was maintained to be filled properly during all reaction tests. In addition, droplets with the larger cargo volume than the average were discarded before they proceeded to the reaction so that the dispensed cargo volume was kept consistent throughout all tests. As shown in the insets of FIG. 6(*a*), the cargo area difference in acceptable droplets and unacceptable ones was visibly noticeable and easy to screen.

In some instances, the engine fluid is not meant to be a reagent for esterification while it is present in the reacting droplet during the course of the reaction. The inertness of the engine fluid was tested to establish that the presence of engine fluid would not interfere the reaction. Moreover, the addition of a color dye to the engine fluid is desirable for clear visualization of experiments, but, like the engine fluid, is often not meant to participate in the esterification reaction. To identify reaction compatibility of the engine and color dye, three off-chip reactions were investigated: (1) the model esterification, (2) the esterification in the presence the ionic liquid, and (3) the esterification in the presence of ionic liquid and the green food dye. As shown in FIGS. 6(*b*) and (*c*), all three reactions showed full conversions and provided the ester product cleanly.

Reaction conditions often need to be optimized to achieve efficient reactions. Typically, optimized reaction conditions can be determined by conversion data from a number of reactions with varying reaction parameters. Such reaction optimization is a tedious process that requires substantial resources including time and efforts, and it generates chemical wastes. An EWOD digital microfluidic technology is particularly useful to address this issue; as an EWOD device can readily provide arrays of droplets and each droplet can carry unique reaction conditions while they are individually controlled. These features make an EWOD device suitable for the high-throughput (in numbers, rather than in volume) screening platform. In this study, 60 on-chip reactions were performed, and the conversion data from these reactions were used to optimize the esterification reaction as followed.

Study of reaction kinetics is an essential part of the reaction optimization because it provides insights into the reaction mechanism. Kinetics study typically associates with a quenching process in which a quenching agent is added to the reaction mixture to stop the reaction at a desired time and conversion measurement is followed. However, quenching a reaction in a macroscale is not a well-controlled process because of the time for applying a quenching agent and its homogeneous diffusion throughout an entire reactor. These factors are, indeed, negligible in microscale reactions due to possible automated fluid handling and the short diffusion length. Consequentially, large numbers of precise conversions data can be obtained quickly and easily in a microscale reaction.

Figure 7:
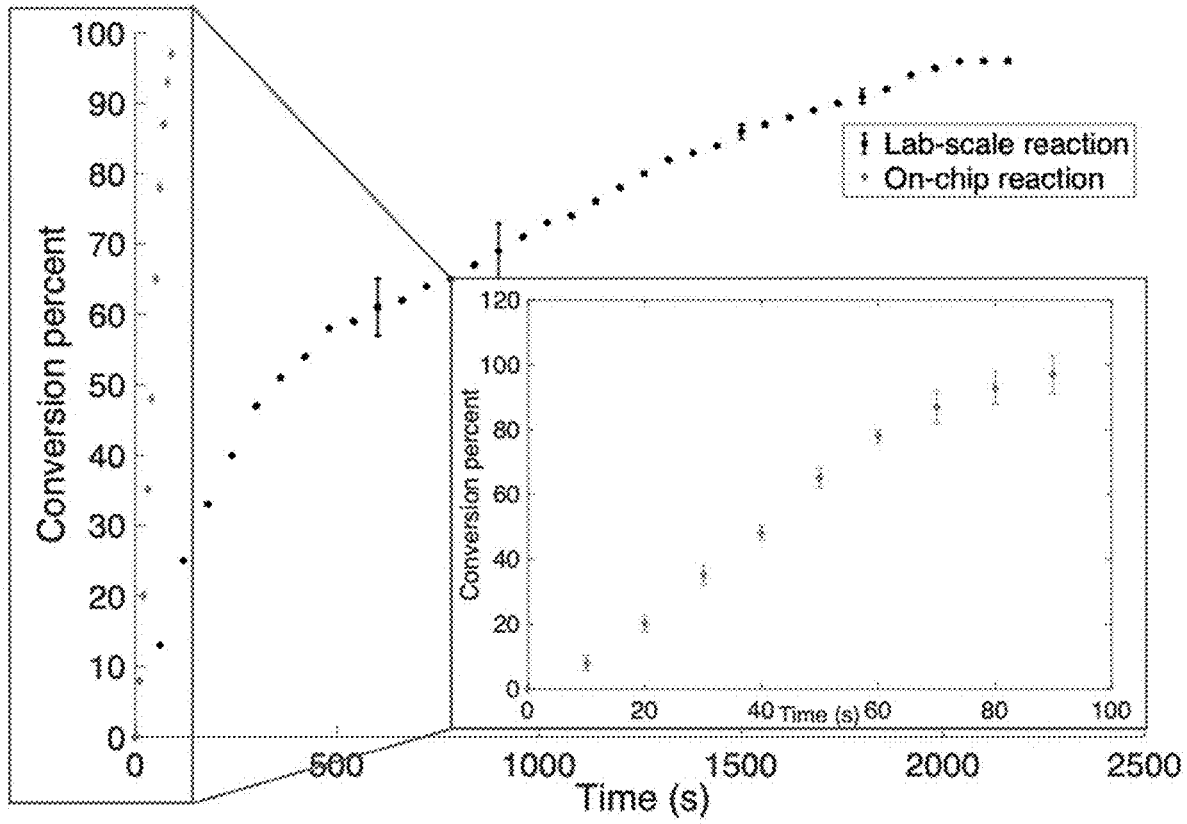
FIG. 7 shows the conversion percent of lab-scale and on-chip esterification of menthol for different reaction times. For all reactions, toluene was used as solvent and concentration of catalyst (DMAP) was kept at 0.5 mol %. Dots and error bars are the average conversions and standard deviations from 3 reactions per each, respectively.

To this end, reactions were quenched at 9 different time intervals, such as at 10-90 seconds (s) at 10 s intervals. FIG. 7 presents kinetic data of same reactions of lab scale (i.e. NMR) tests and on-chip tests. As shown, the conversion from reactants to the product increased as the reaction proceeds in both lab-scale and on-chip reactions. This confirms that an EWOD chip is capable to carry out accurate quenching of reactions and to provide quick and easy kinetic data. A notable difference between on-chip and off-chip reactions was reaction kinetics; substantially improved kinetics of the on-chip reactions was observed. For example, while the lab-scale reaction reached to 90% conversion in 30 min, the on-chip reaction reached to 97% conversion only in 90 s. This result agrees very well with the reports of esterification reactions in microchannel reactors. Standard deviation of conversion percent at each quenching time was evaluated. Standard deviation of on-chip and lab scales ranged very similar (~±3%) even though on-chip quenching was done with much short time interval, thus more challenging. Standard deviations of on-chip reaction measurement became bit larger in the later time because of possible evaporation of the reaction mixture. Overall, an EWOD microfluidics is a versatile microscale organic chemical reaction platform which can deliver significantly enhanced reaction kinetics with precise reaction control. One can use this technology to determine the order of reactions and the reaction rate constants.

Figure 9:
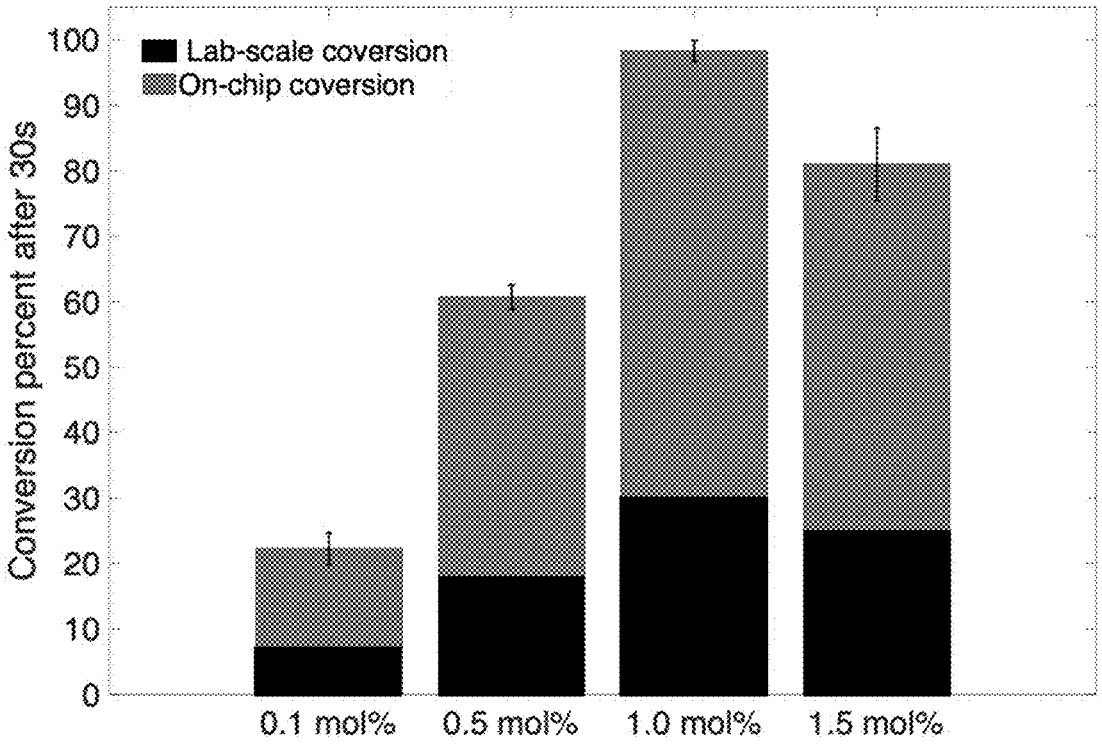
FIG. 9 is a graphical comparison the conversion percent of lab-scale and on-chip esterification of menthol with the concentration of DMAP. For the catalyst loading optimization study, the type of solvent (toluene) and the reaction time (30 s) were fixed for all tests.

As seen from FIG. 9, the higher concentration of DMAP resulted in better yield. However, the loading of 1.5 mol % of DMAP slightly diminished yield. It is likely attributed to solubility of DMAP in toluene, impacting on reaction kinetics. For instance, at the higher concentration of DMAP, pyridinium salt precipitates, which might lead to off-cycle of the catalyst. Similar results have been observed for this reaction using flask-based chemistry. Similar to the solvent screening case, on-chip data agrees very well with lab-scale data in this case. Lab-scale reaction shows lower conversions than on-chip reaction due to its slower kinetics given the reaction time (30 s), yet both tests reach to the same conclusion in optimal concentration of DMAP.

Figure 8:
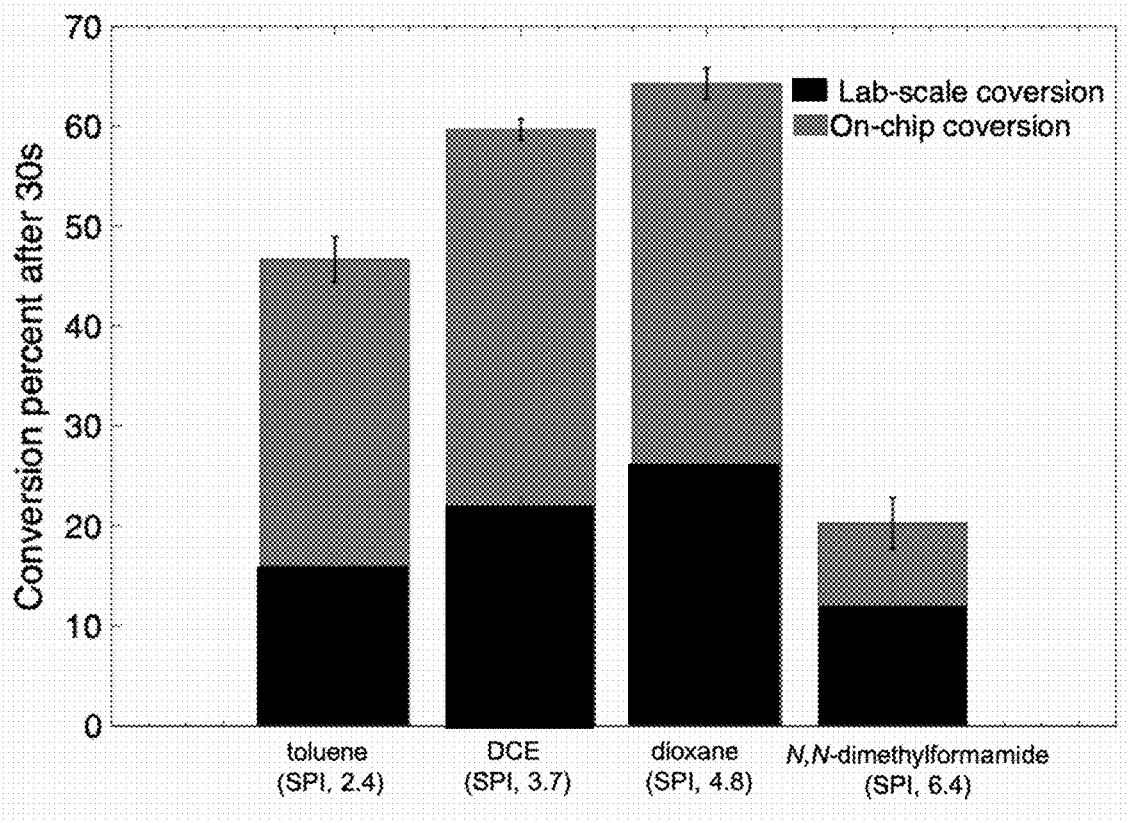
FIG. 8 is a graphical comparison of the conversion of lab-scale and on-chip esterification of menthol in the presence of different solvents including toluene, dioxane, N,N-dimethylformamide, and DCE, at first 30 s. The concentration of catalyst was kept at 0.5 mol % throughout all the solvent screening experiments. The secondary y axis indicates Solvent Polarity Index (SPI). As it is evident esterification with less polar solvents screened in this study generally gave substantially higher conversions than with the reaction with polar counterpart.

Different solvents were tested to study their impact on esterification reaction. For all tests, catalyst concentration and reaction time were fixed at 0.5 mol % and 30 s, respectively. A conversion rate of esterification of menthol with $Ac_2O$ in four different solvents are shown in FIG. 8 where SPI indicates solvent polarity index. Esterification of menthol with less-polar solvents screened in this study [e.g., DCE (SPI, 3.7), dioxane (SPI, 4.8), and toluene (SPI, 2.4)] gave substantially higher conversions, compared with the reaction with polar solvent [e.g., N,N-dimethylformamide (SPI, 6.4)]. This result generally agrees with literature precedents which concern flask-based reactions. In both macroscale experiments from literature and the microscale reactions in this study, the SPI values of those less-polar solvents do not proportionally correlated with the order of the reaction efficiency, presumably because other reaction parameters can together impact on the overall efficiency of the reactions.

DMAP has been an efficient catalyst for traditional flask-based acylation reactions. In this study, DMAP is demonstrated to be a useful catalyst for esterification of the less reactive alcohols (i.e., secondary alcohols) on EWOD microfluidics platform. To investigate the optimal loading of DMAP, four different concentrations (0.1, 0.5, 1.0, and 1.5 mol %) were examined.

As seen from FIG. 9, the higher concentration of DMAP resulted in better yield. However, the loading of 1.5 mol % of DMAP slightly diminished yield. It is likely attributed to solubility of DMAP in toluene, impacting on reaction kinetics. For instance, at the higher concentration of DMAP, pyridinium salt precipitates, which might lead to off-cycle of the catalyst. A similar result has been observed in flask-based chemistry. Similar to the solvent screening case, on-chip data agrees very well with lab-scale data in this case. Lab-scale reaction shows lower conversions than on-chip reaction due to its slower kinetics given the reaction time (30 s), yet both tests reach to the same conclusion in optimal concentration of DMAP Over the past decades, microscale combinational synthesis has been actively sought. For example, it has been demonstrated using 2×2 combinatorial synthesis of amides through a parallel micro-flow reactor system in a single glass microchip. This approach is mainly based on micro unit operations (MUOs) in pressure driven multi-phase laminar flow networks. A droplet-based microfluidic platform for combinatorial library synthesis of potential drug candidates has also been explored, where a 7×3 library of potential enzyme inhibitors was used. In both cases the design and architecture of the devices are quite complicated. For example, the 2×2 combinatorial synthesis of amides utilized three parallel plates to prevent the cross-contamination that caused the complexity in the fabrication process.

In contrast, an EWOD digital microfluidic device intrinsically has multiplexing capability so that achieving M×N combinations of reactants can be easily done without any complicate modification of a device. Moreover, each droplet can form an independent microreactor; therefore, cross-contamination and crosstalk can be minimized or eliminated, and reaction conditions constituting each combination of reactants can be individually controlled or altered. As a demonstration of the use of an EWOD device for combinatorial syntheses, esterification reactions were performed using three different substrates in a single device. Each droplet was independently generated and manipulated; all other reaction conditions, e.g., solvent, catalyst concentration, and reaction time, were predetermined (FIG. 5(*g*)).

Figure 10:
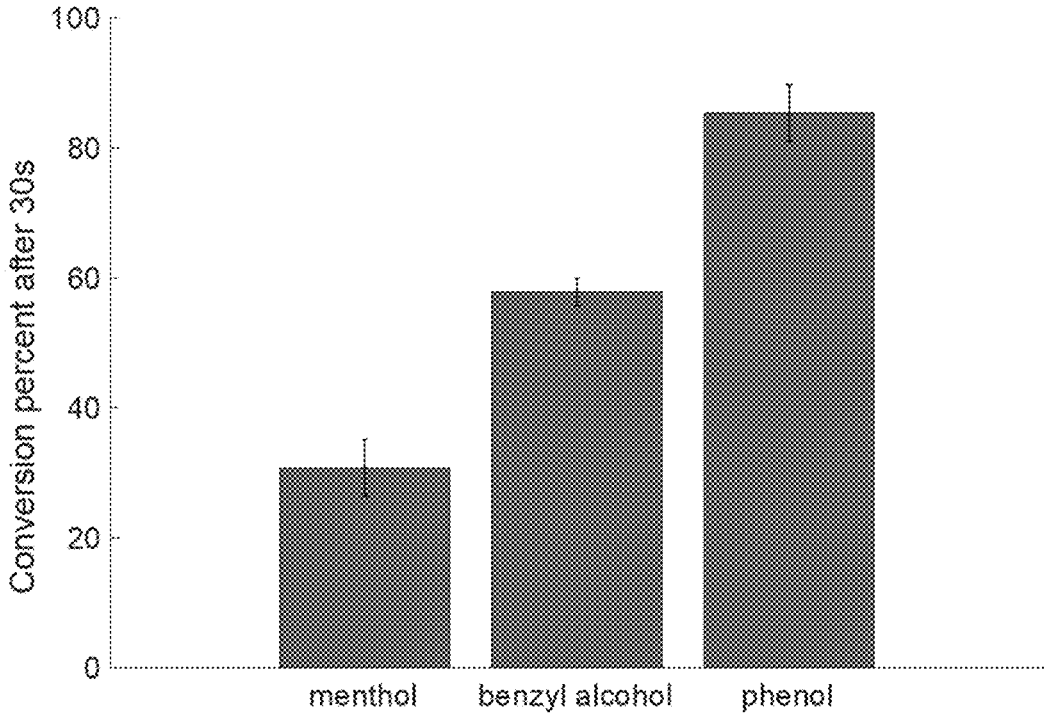
FIG. 10 is a graphical comparison of esterification yields in different solvents.

As shown in FIG. 10, phenol underwent the esterification in the high yield (85%), compared to benzyl alcohols and menthol in the first 30 s of the reactions. This result is consistent with well-known reactivity of acylation of alcohols and phenols. Structurally, phenol possesses more acidic hydrogen, yet a less nucleophilic oxygen donor than the alcohols. This feature leads to mechanistically different reaction pathways; phenols first undergo facile deprotonation by either DMAP or auxiliary base (e.g., $Et_3N$) and the resulting oxyanion attacks acylpyridinium ion generated from a reaction of $Ac_2O$ and DMAP. This differs from nucleophilic attack of alcohol to acylpyridinium followed by deprotonation. As expected, sterically less encumbered benzyl alcohol is more reactive toward acylation vis-à-vis menthol. Overall, this shows that an EWOD device is capable of hosting a library of reagents and permitting combinatorial organic synthesis with organic solvents. Notably, this technology will be a valuable tool for rapidly elucidating of the reactivity difference of reagents or substrates and providing mechanistic insights into a range of organic transformations.

Methods described herein demonstrate that an EWOD digital microfluidic platform is an alternative or a complementary tool to microreactors based on continuous channel flow for organic synthesis. A "engine-and-cargo" strategy is described that addresses the shortcoming of an EWOD device; the novel method makes an EWOD device capable of handling electrically non-responsive fluids, particularly organic solvents, where organic fluids are not generally electrically movable. With the engine-and-cargo approach, esterification involving alcohols and phenols with acetic anhydride in the presence of base and DMAP were successfully carried out on EWOD devices. The study on reaction kinetics established benefits from an EWOD device on account of rapid and precise quenching of reactions. Furthermore, rapid reaction optimization was realized on a EWOD device, examining two parameters including solvents and catalyst loading. Finally, 3×1 combinatorial synthesis of esters with three substrates was completed in a rapid fashion.

While esterification was used as an exemplary reaction, methods described herein are not limited to this reaction. Instead, the skilled artisan would appreciate that nearly any organic reaction not inconsistent with the objectives of this disclosure can be performed using the methods described herein. For instances, any organic reaction requiring the use of a solvent without electrowetting properties could be performed on an EWOD device, such as substitution reaction, elimination reactions, addition reactions, oxidation-reduction reactions, or radical reactions.

The invention claimed is:

1. A method of moving a solvent that is not movable by electro-wetting-on-dielectric (EWOD) actuation on an EWOD microfluidic device, the method comprising:

disposing a first droplet of a first fluid that is movable by EWOD actuation on a surface of the EWOD microfluidic device, the first fluid comprising an ionic liquid;

disposing a second droplet of a second fluid that is not movable by EWOD actuation on the surface;

applying a first voltage to the surface to move the first droplet towards the second droplet;

contacting the first droplet with the second droplet to form an encapsulated droplet, where the second droplet encapsulates the first droplet.

2. The method of claim 1, further comprising transporting the encapsulated droplet across the surface by applying a second voltage to the surface, the second voltage being the same or different from the first voltage.

3. The method of claim 1, wherein the ionic liquid comprises an organic cation that is imidazolium-based, pyridinium-based, pyrrolidinium-based, phosphonium-based, ammonium based, sulfonium-based, or any combination thereof.

4. The method of claim 3, wherein the ionic liquid comprises an anion that is an alkylsulfate, tosylate, methansulfonate, trifluoromethanesulfonate (triflate), bis(trifluoromethylsulfonyl)imide, tetrafluoroborate, hexafluorophosphate, a halide, or any combination thereof.

5. The method of claim 1, wherein the ionic liquid is 1-butyl-3-methylimidazolium hexafluorophosphate (BMIM-PF6).

6. The method of claim 1, wherein the second fluid has a lower surface tension than water.

7. The method of claim 1, wherein the second fluid is an organic solvent.

8. The method of claim 1, wherein the first fluid has a higher surface tension than the second fluid.

9. The method of claim 1, further comprising forming two or more encapsulated droplets on the surface, each of the two or more encapsulated droplets comprising the second droplet encapsulating the first droplet.

10. The method of claim 9, wherein the second fluid of each encapsulated droplet comprises one or more reactants.

11. The method of claim 9, further comprising applying a second voltage to the surface to move the two or more encapsulated droplets together, the second voltage being the same or different from the first voltage.

12. The method of claim 11, further comprising merging the two or more encapsulated droplets together.

13. The method of claim 12, wherein merging the two or more encapsulated droplets comprises mixing the second fluid from each encapsulated droplet together.

14. The method of claim 12, wherein merging the two or more encapsulated droplets together initiates a chemical reaction between one or more reactants present in the two or more encapsulated droplets.

15. The method of claim 9, wherein the second fluid in each encapsulated droplet is the same.

16. The method of claim 9, wherein the second fluid in each encapsulated droplet is different.

17. The method of claim 9, wherein the first fluid in each encapsulated droplet is the same or different.

18. The method of claim 9, wherein the first fluid and the second fluid are immiscible.

19. A method of moving a solvent that is not movable by electro-wetting-on-dielectric (EWOD) actuation on an EWOD microfluidic device comprising:

combining a first fluid with an immiscible second fluid in an EWOD reservoir puddle, the first fluid being an ionic liquid movable through EWOD actuation and the second fluid being unmovable through EWOD actuation;

moving a first droplet of the first fluid out of the reservoir puddle by applying a voltage to a surface of the EWOD device; and encapsulating the first droplet with a second droplet of the second fluid as the first droplet is moved out of the reservoir puddle to form an encapsulated droplet.

* * * * *